US007406273B2

(12) United States Patent
Kamimura et al.

(10) Patent No.: US 7,406,273 B2
(45) Date of Patent: Jul. 29, 2008

(54) IMAGE FORMING APPARATUS INTO WHICH REPLACEABLE UNITS ARE DETACHABLY ATTACHED

(75) Inventors: Naoya Kamimura, Nagoya (JP); Tomoaki Hattori, Nagoya (JP); Takuji Matsuno, Nagoya (JP); Masashi Suzuki, Nagoya (JP); Kazushi Fukuta, Nagoya (JP); Yoshimitsu Doi, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 369 days.

(21) Appl. No.: 11/186,496

(22) Filed: Jul. 21, 2005

(65) Prior Publication Data

US 2006/0018671 A1 Jan. 26, 2006

(30) Foreign Application Priority Data

Jul. 21, 2004 (JP) ..... 2004-213067

(51) Int. Cl.
*G03G 15/00* (2006.01)

(52) U.S. Cl. ..... 399/13

(58) Field of Classification Search ..... 399/12, 399/13, 113

See application file for complete search history.

(56) References Cited

U.S. PATENT DOCUMENTS 5,530,531 A * 6/1996 Girard
5,558,331 A * 9/1996 Zlotsky
5,788,232 A * 8/1998 Binkley
RE36,301 E * 9/1999 Kai et al. ..... 399/113
6,600,881 B2 * 7/2003 Cornelius ..... 399/12

FOREIGN PATENT DOCUMENTS

JP 2-184867 A1 7/1990
JP 2001-075328 A1 3/2001

OTHER PUBLICATIONS

Patent Abstracts of Japan for JP2-184867 published Jul. 19, 1990.
Patent Abstracts of Japan for JP2001-075328 published Mar. 23, 2001.

* cited by examiner

*Primary Examiner*—Susan S Lee
(74) *Attorney, Agent, or Firm*—Darby & Darby P.C.

(57) ABSTRACT

A replaceable unit that is removably coupled to a storage portion of a main body provided in an image forming apparatus, the replaceable unit having a first picture split provided on the replaceable unit that forms a finished picture with a second picture split provided on the main body of the image forming apparatus when the replaceable unit is coupled to the storage portion.

7 Claims, 8 Drawing Sheets

IMAGE FORMING APPARATUS INTO WHICH REPLACEABLE UNITS ARE DETACHABLY ATTACHED

INCORPORATION BY REFERENCE

The present application claims priority under 35 U.S.C. § 119 to Japanese Patent Application No. 2004-213067 filed on Jul. 21, 2004. The content of the application is incorporated herein by reference in its entirety.

BACKGROUND OF THE INVENTION

1. Field of the Invention

The present invention relates to a replaceable unit for use in an image forming apparatus and the image forming apparatus into which the replaceable unit is detachably attached. Particularly, the present invention relates to a replaceable unit prevented from being incorrectly attached into an image forming apparatus and the image forming apparatus into which the replaceable unit is detachably attached.

2. Description of the Related Art

As for a replaceable unit detachably attached into an image forming apparatus, arrow-shaped recesses have been heretofore provided in a front surface of the replaceable unit in order to indicate a direction of attachment of the replaceable unit into the image forming apparatus. Contrast between each arrow-shaped recess and a portion surrounding the recess is however so insufficient that it is difficult for a user to recognize the arrow shape when the installation location of the image forming apparatus is not bright. Accordingly, there is a problem that the replaceable unit may be attached into the image forming apparatus in an incorrect direction.

In order to solve the above problem, there is disclosed an example in which an identification label is put on the replaceable unit, the identification label indicating a direction of attachment of a replaceable unit (See JP-A-2001-075328).

As for an image forming apparatus into which the replaceable unit is detachably attached, there is however another problem that it is difficult to find out where to put the replaceable unit when the inside of the image forming apparatus is dark. In order to solve this problem, there is disclosed an example in which at least one of lamps used as heat sources for an exposure unit, a light irradiation unit and a fixing unit is turned on so as to illuminate the inside of the image forming apparatus when a process cartridge in the image forming apparatus is to be exchanged for a new one (See JP-A-2-184867).

SUMMARY OF THE INVENTION

In order to prevent the replaceable unit from being incorrectly attached into the image forming apparatus, there can be essentially conceived the case where a measure to prohibit incorrect insertion is taken on the replaceable unit and the case where a measure to prohibit incorrect insertion is taken on the image forming apparatus.

The technique disclosed in JP-A-2001-075328 relates to the case where a measure to prohibit incorrect insertion is taken on the replaceable unit. In this case, the labor for placing the label to the image forming apparatus is required as well as the label must be provided as a component. Moreover, there is possibility that the label may be peeled or damaged. In this case, there is a problem that the replaceable unit may be incorrectly inserted because of unawareness of the place to insert the replaceable unit.

The technique disclosed in JP-A-2-184867 relates to the case where a measure to prohibit incorrect insertion is taken on the image forming apparatus. In this case, it is generally difficult to find out the place to insert the replaceable unit into the image forming apparatus because shadows of various components are apt to be generated in the inside of the image forming apparatus. Particularly when a plurality of replaceable units are to be inserted, there is a problem that the place to insert each of the replaceable units may be confused easily due to the shadows so that the replaceable units are inserted incorrectly.

One of objects of the invention aims at the case where a measure to prohibit incorrect insertion is taken on the replaceable unit, and is to provide a replaceable unit which is detachably attached into an image forming apparatus and which can be prohibited from being inserted into the image forming apparatus incorrectly. A second one of objects of the invention aims at the case where a measure to prohibit incorrect insertion is taken on the image forming apparatus, and is to provide the image forming apparatus having an indication of a position where the replaceable unit is stored, the image forming apparatus being provided with a mechanism for inserting the replaceable unit in the storage position.

According to a first aspect of the invention, there is provided a replaceable unit that is detachably attached into an image forming apparatus, the replaceable unit including: a first cover member provided with a through hole that indicates a direction of the attachment and the detachment of the replaceable unit with respect to the image forming apparatus; and a second cover member having a color different from a color of the first cover member, and being formed to block the through hole from inner side of the replaceable unit when the first cover member is attached to the second cover member.

According to a second aspect of the invention, there is provided an image forming apparatus including: a storage portion; and a replaceable unit that is detachably attached into the storage portion, the replaceable having: a first cover member provided with a through hole that indicates a direction of the attachment and the detachment of the replaceable unit with respect to the image forming apparatus; and a second cover member having a color different from a color of the first cover member, and being formed to block the through hole from inner side of the replaceable unit when the first cover member is attached to the second cover member. At least part of a portion of the second cover member with which blocks the through hole is provided as a protrusion that protrudes from an abutting surface of the second cover member abutting on the first cover member. The through hole has a front end portion that is expanded from a base portion. The protrusion engages with the front end portion of the through hole when the second cover member is attached to the first cover member. The replaceable member is detachably attached into the storage portion in a direction that the front end portion is formed in the through hole. According to a third aspect of the invention, there is provided an image forming apparatus including: a storage portion; and a replaceable unit that is detachably attached into the storage portion, the replaceable having: a first cover member provided with a through hole that indicates a direction of the attachment and the detachment of the replaceable unit with respect to the image forming apparatus; and a second cover member having a color different from a color of the first cover member, and being formed to block the through hole from inner side of the replaceable unit when the first cover member is attached to the second cover member, wherein the storage portion is formed so that the through hole of the replaceable unit cannot be visually recognized in a condition that the replaceable unit is stored in the storage portion.

According to a fourth aspect of the invention, there is provided a replaceable unit that is detachably attached into an image forming apparatus, the replaceable unit including a picture split provided on the replaceable unit that forms a finished picture with a corresponding picture split provided on the image forming apparatus when the replaceable unit is attached into the image forming apparatus, wherein the picture split of the replaceable unit is provided at a portion that is visually recognizable in a condition that the replaceable unit is attached into the image forming apparatus.

According to a fifth aspect of the invention, there is provided an image forming apparatus comprising: a main body that is provided with a storage portion; and a replaceable unit that is detachably attached into the storage portion and is provided with a first picture split. The second picture split is provided at a portion that is visually recognizable in a condition that the replaceable unit is attached into the image forming apparatus.

According to a sixth aspect of the invention, there is provided an image forming apparatus including: a storage portion that stores a replaceable unit that is detachably attached into the storage portion; and a light emitting portion that is provided in a wall surface of the storage portion, and indicates a position to attach the replaceable unit.

DETAILED DESCRIPTION OF THE PREFERRED EMBODIMENTS

An embodiment of the invention will be described below with reference to the drawings.

First, description will be made in the case where a measure to prohibit incorrect insertion is taken on a replaceable unit.

Figure 1:
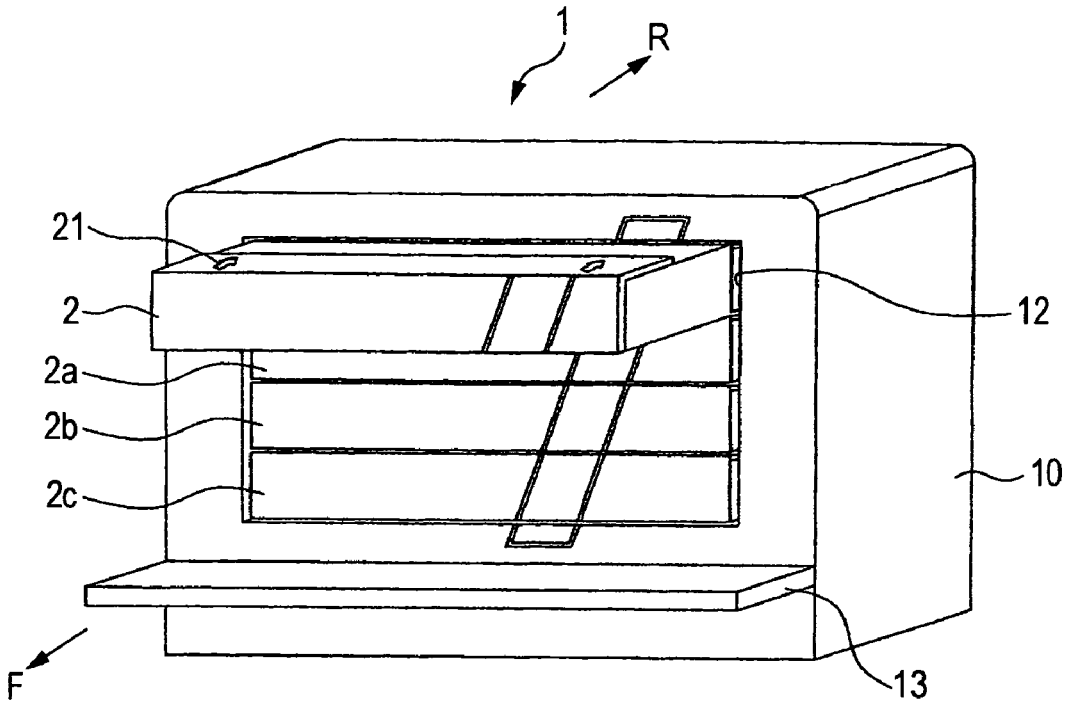
FIG. 1 is a perspective view showing replaceable units for use in an image forming apparatus according to an embodiment of the invention and the image forming apparatus into which the replaceable units are detachably attached.

FIG. 1 is a perspective view showing replaceable units for use in an image forming apparatus according to the invention and the image forming apparatus into which the replaceable units are detachably attached. In FIG. 1, the reference numeral 1 designates an image forming apparatus; 2, 2*a*, 2*b* and 2*c*, a plurality of replaceable units to be detachably attached into the image forming apparatus 1; 12, a storage portion provided in a main body 10 of the image forming apparatus 1; and 13, a door with which the storage portion 12 is covered. The image forming apparatus 1 is fitted with the door 13. The embodiment will be described on the assumption that the plurality of replaceable units to be detachably attached into the image forming apparatus 1 are process cartridges.

As shown in FIG. 1, the storage portion 12 for attaching and detaching the plurality of replaceable units 2, 2*a*, 2*b* and 2*c* is opened on a front side (in a direction shown by an arrow F in FIG. 1) of the image forming apparatus 1. The replaceable units 2, 2*a*, 2*b* and 2*c* are inserted into the storage portion 12 as follows. For example, the replaceable unit 2 is inserted into the storage portion 12 along arrows 21 provided on the replaceable unit 2 from the front side of the image forming apparatus 1 toward the rear side thereof (in a direction shown by an arrow R in FIG. 1). The other replaceable units 2*a*, 2*b* and 2*c* are inserted into the storage portion 12 in the same manner as the replaceable unit 2. The storage portion 12 is covered with the door 13 unless the replaceable units 2, 2*a*, 2*b* and 2*c* are being attached or detached into or from the storage portion 12.

Figure 2:
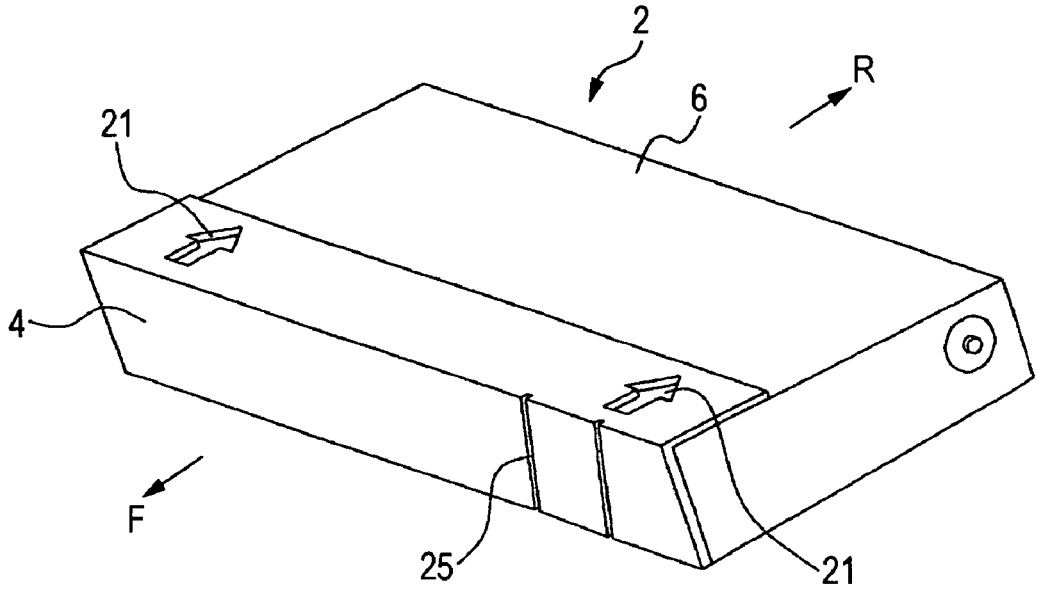
FIG. 2 is a perspective view showing a replaceable unit.

FIG. 2 shows the replaceable unit 2. The replaceable unit 2 includes a first cover member 4, and a second cover member 6. The first cover member 4 and the second cover member 6 are combined with each other by the arrows 21. Each arrow 21 is formed to indicate a direction of insertion of the replaceable unit 2 into the image forming apparatus 1.

The first cover member 4 and the second cover member 6 are formed as members different in color. Accordingly, the color of the arrows 21 of the replaceable unit 2 which can be viewed from above is the color of the second cover member 6.

Figure 3:
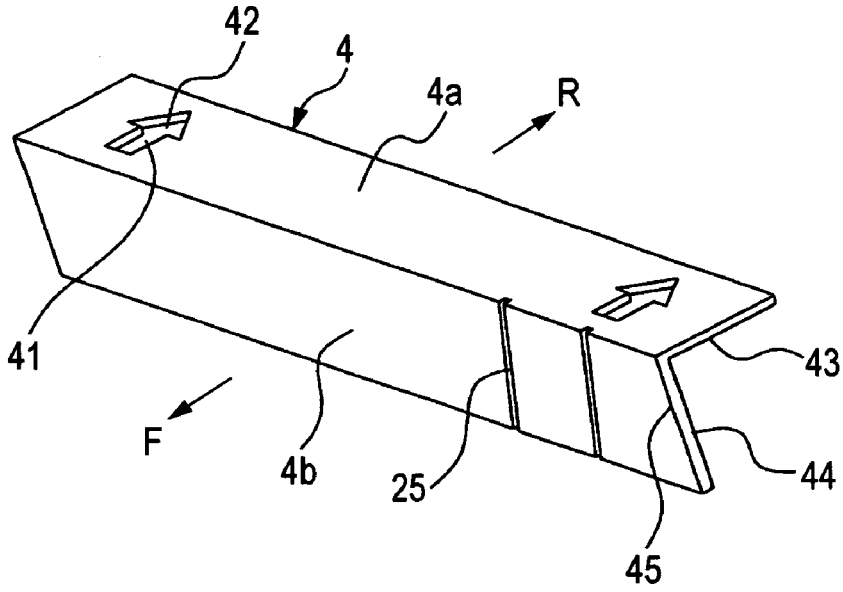
FIG. 3 is a perspective view showing a first cover member.

FIG. 3 shows the first cover member 4. The first cover member 4 is a channeling member substantially shaped like an inverted L figure. The first cover member 4 is composed of a horizontal flange 4*a* and a vertical flange 4*b*. The horizontal flange 4*a* and the vertical flange 4*b*, each of which is substantially rectangular, are integrally molded.

Arrow-shaped through holes 41 are provided near opposite end portions of the horizontal flange 4*a*. Each of the through holes 41 has a through hole front end portion 42 that is expanded from a base portion when viewed from a top side of the horizontal flange 4*a*. The through hole front end portions 42 of the through holes 41 are molded to indicate the direction (the direction shown by the arrow R in FIG. 3) of insertion of the replaceable unit 2 into the image forming apparatus 1 when the first cover member 4 and the second cover member 6 are combined with each other. A picture split (a first picture split) 25 is formed as a concave and convex face in a front surface 45 of the vertical flange 4*b*.

Figure 4:
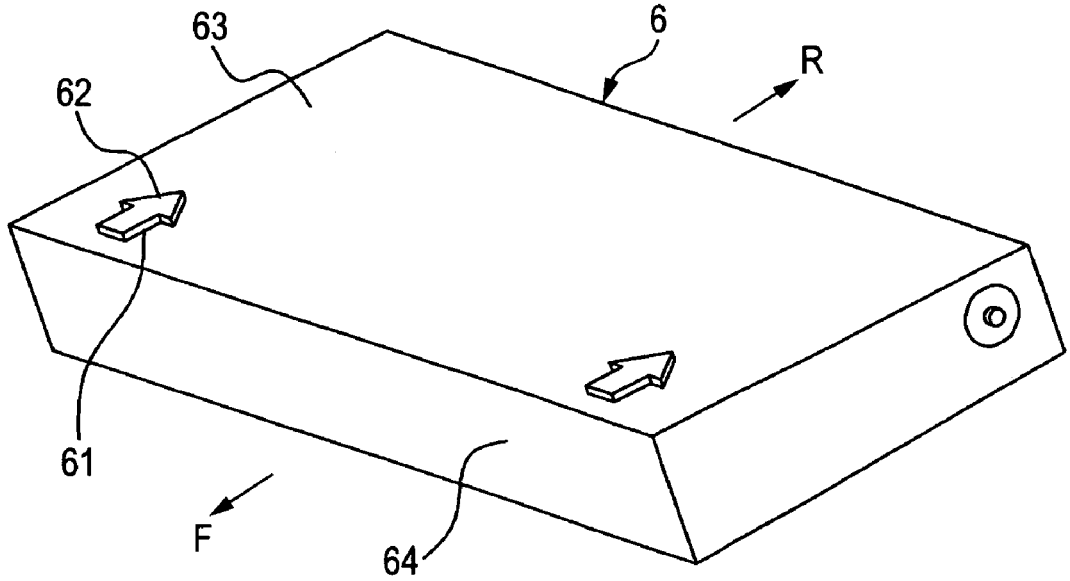
FIG. 4 is a perspective view showing a second cover member.

FIG. 4 shows the second cover member 6. The second cover member 6 is a member substantially shaped like a rectangular parallelepiped. Arrow-shaped protrusions 61 are formed on an upper surface 63 of the second cover member 6. The protrusions 61 are located in positions corresponding to those of the through holes 41 provided in the first cover member 4. Protrusion front end portions 62 of the protrusions 61 are formed to indicate the direction (the direction shown by an arrow R in FIG. 3) of insertion of the replaceable unit 2 into the image forming apparatus 1 when the first cover member 4 and the second cover member 6 are combined with each other.

For combination of the first cover member 4 and the second cover member 6 with each other, a lower surface 43 of the horizontal flange 4*a* of the first cover member 4 is made to abut on the upper surface 63 of the second cover member 6 while a rear surface 44 of the vertical flange 4*b* of the first cover member 4 is made to abut on a front surface 64 of the second cover member 6.

As a result, the protrusions 61 of the second cover member 6 are fitted into the through holes 41 of the first cover member 4, so that the first cover member 4 and the second cover member 6 are combined with each other. On this occasion, the protrusion front end portions 62 of the protrusions 61 of the second cover member 6 engage with the through hole front end portions 42 of the through holes 41 of the first cover member 4, so that the first cover member 4 is never disconnected from the second cover member 6 even if the replaceable unit 2 is pulled forward in a direction that the user pulls out the replaceable member 2 (in a direction shown by the arrow F in FIG. 2) after the combination. The engagement between the protrusions 61 and the through holes 41 is thus assured due to the configuration that the through hole front end portions 42 are expanded from the base portion of the through holes 41, and the expanded through hole front end portions 42 hook with the protrusion front end portions 62 of the protrusions 61. In the embodiment, the through holes 41 and the protrusions 61 are formed in an arrowed shape as shown in the drawings. However, the through holes 41 and the protrusions 61 may be formed in a shape other than the arrowed shape, such as a T lettered shape, in so far as the shape has a front end portion being expanded from abase portion, thereby to exert the advantage of assuring the engagement between the through holes 41 and the protrusions 61.

As described above, in the condition that the first cover member 4 and the second cover member 6 are combined with each other, the color of the arrows 21 of the replaceable unit 2 is the color of the second cover member 6 which is different from the color of the first cover member 4. Accordingly, the arrows 21 to indicate the direction of insertion of the replaceable unit 2 into the image forming apparatus 1 can be visually recognized easily due to color contrast between the color of the first cover member 4 and the color of the second cover member 6.

Moreover, the thickness of each of the protrusions 61 of the second cover member 6 can be made unequal to the depth of each of the through holes 41 of the first cover member 4. In this manner, the arrows 21 of the replaceable unit 2 are molded to form a concave and convex face with respect to the upper surface of the first cover member 4 in the condition that the first cover member 4 and the second cover member 6 are combined with each other.

That is, when the thickness of each of the protrusions 61 is smaller than the depth of each of the through holes 41, the arrows 21 dent into the upper surface of the first cover member 4. When the thickness of each of the protrusions 61 is larger than the depth of each of the through holes 41, the arrows 21 protrude from the upper surface of the first cover member 4. In this manner, the user can recognize the arrows 21 of the replaceable unit 2 both by visual sense based on the color contrast and by tactile sense based on the concave and convex face of the arrows 21. Accordingly, the direction of the arrows 21 of the replaceable unit 2 can be recognized more easily.

Next, an operating state for attaching the replaceable unit 2 into the image forming apparatus 1 will be described.

In order to insert the replaceable unit 2 into the storage portion 12 of the image forming apparatus 1, the replaceable unit 2 can be inserted in the direction of the arrows 21 as shown in FIG. 1. As described above, the user can recognize the arrows 21 of the replaceable unit 2 both by visual sense based on the color contrast and by tactile sense based on the concave and convex face of the arrows 21.

As represented by the replaceable units 2, 2*a*, 2*b* and 2*c* shown in FIG. 1, the arrows of the replaceable units 2, 2*a*, 2*b* and 2*c* cannot be recognized visually from the user's side when the replaceable units 2, 2*a*, 2*b* and 2*c* are entirely inserted into the image forming apparatus 1. Accordingly, because the user need not visually recognize the arrows to confirm the attachment of the replaceable units, the user's labor can be saved.

Figure 11:
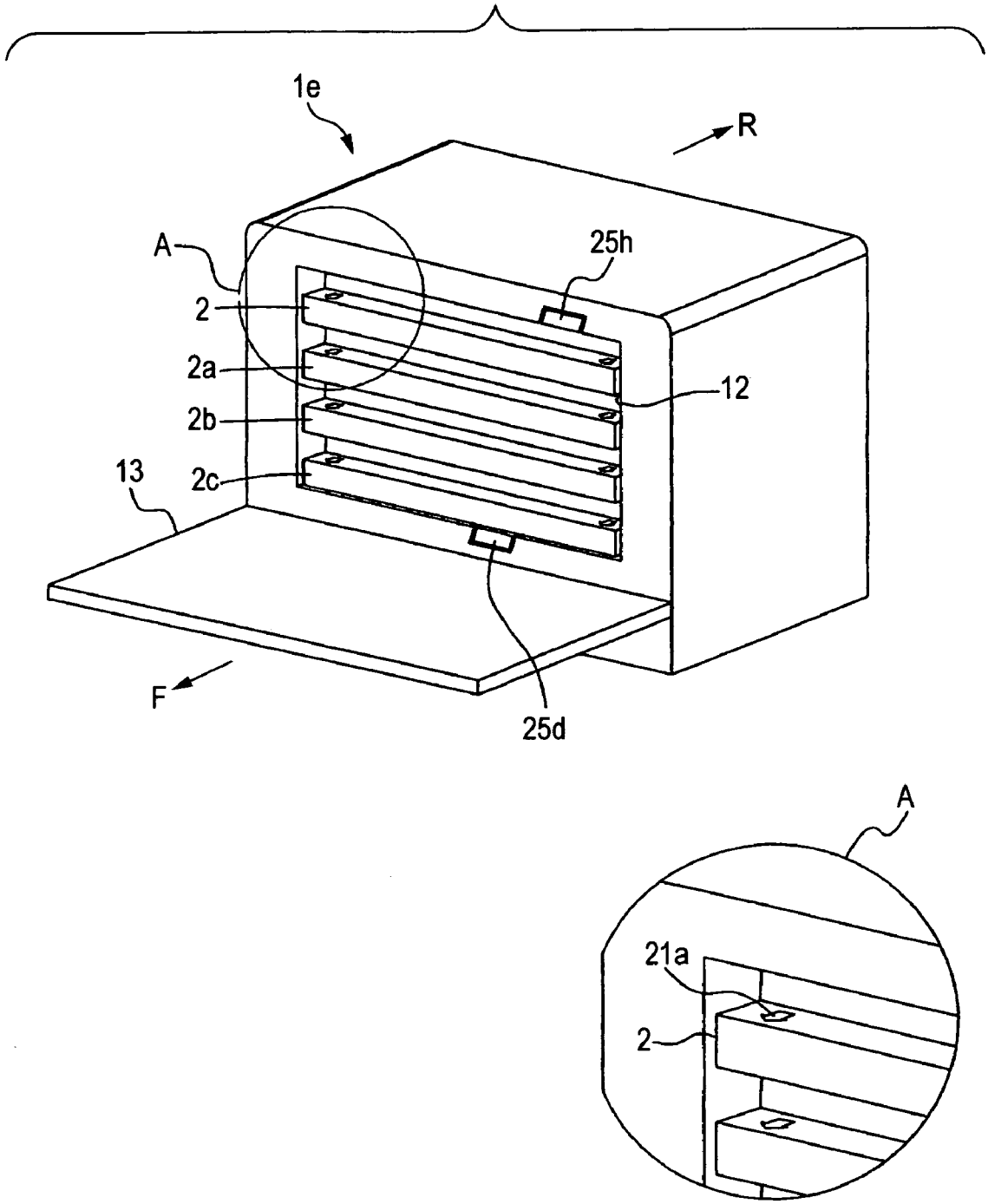
FIG. 11 is a view showing an example in which a direction of detachment of each replaceable unit form an image forming apparatus is indicated on the replaceable unit.

FIG. 11 shows replaceable units having indications of a detachment direction when the replaceable units are to be detached from the image forming apparatus. In FIG. 11, replaceable units 2, 2*a*, 2*b* and 2*c* are stored in a storage portion 12 of an image forming apparatus 1*e*. Because arrows 21*a* to indicate the detachment direction are provided in the replaceable units 2, 2*a*, 2*b* and 2*c*, the user can detach each of the replaceable units 2, 2*a*, 2*b* and 2*c* from the image forming apparatus 1*e* in the direction of the arrows 21*a*.

Figure 5A:
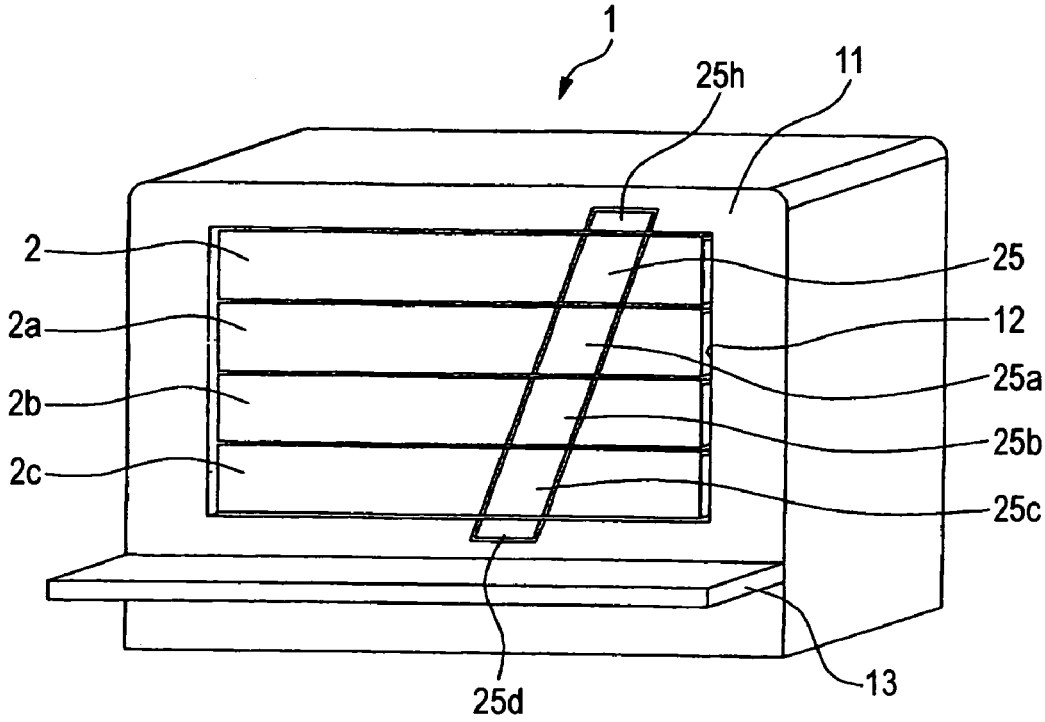
FIGS. 5A and 5B are views showing picture splits provided in front surfaces of replaceable units.
Figure 5B:
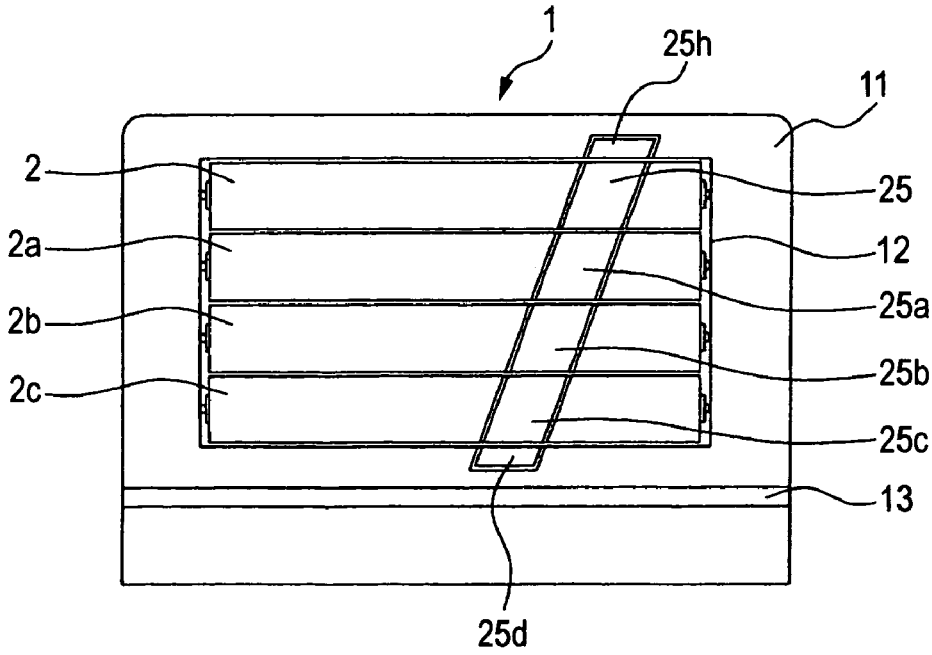
Figure 6A:
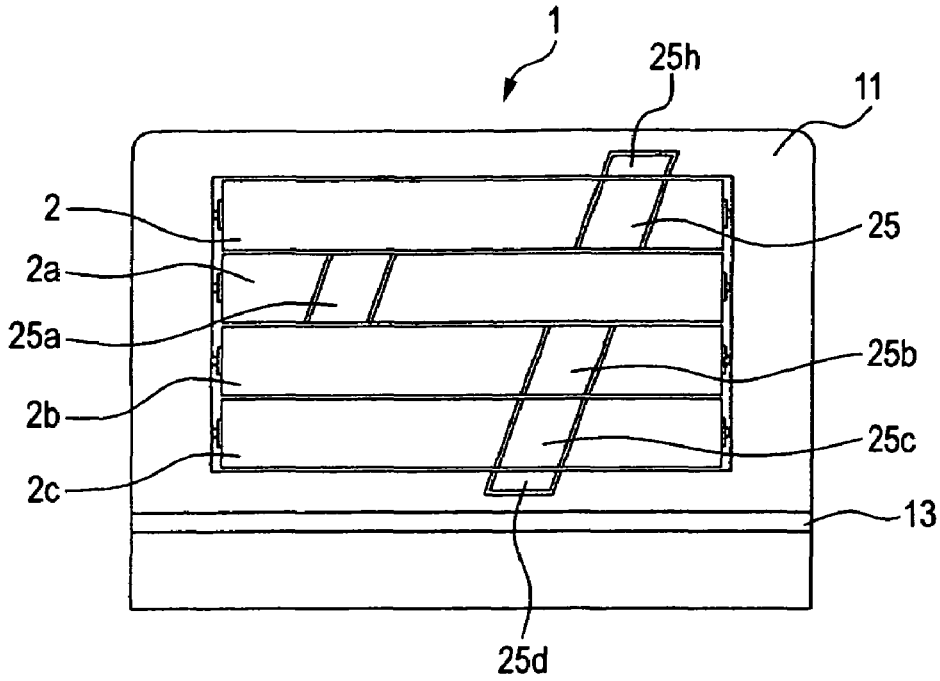
FIGS. 6A and 6B are views showing states where a finished picture is not formed from the picture splits.
Figure 6B:
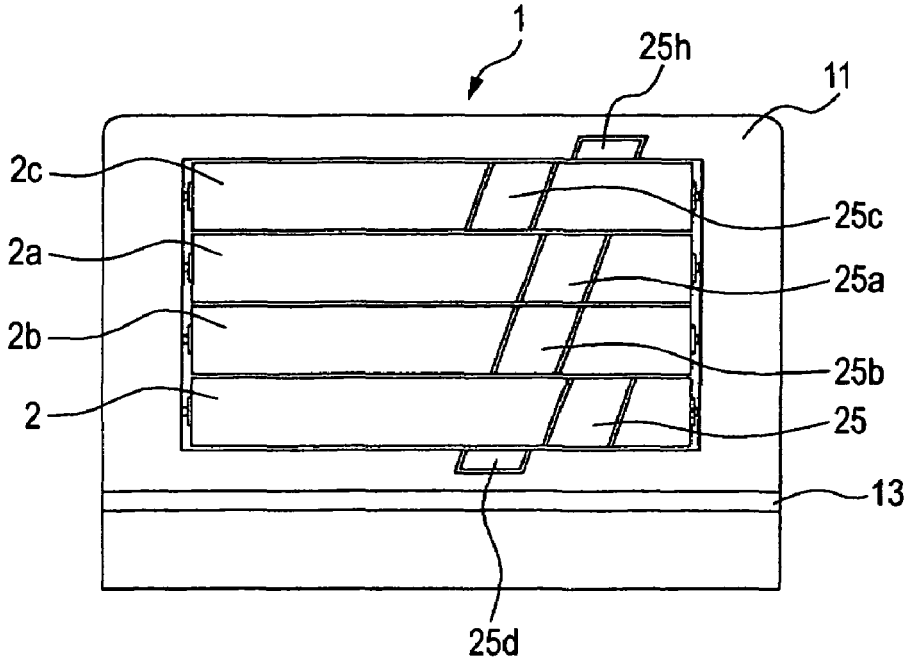
Figure 7A:
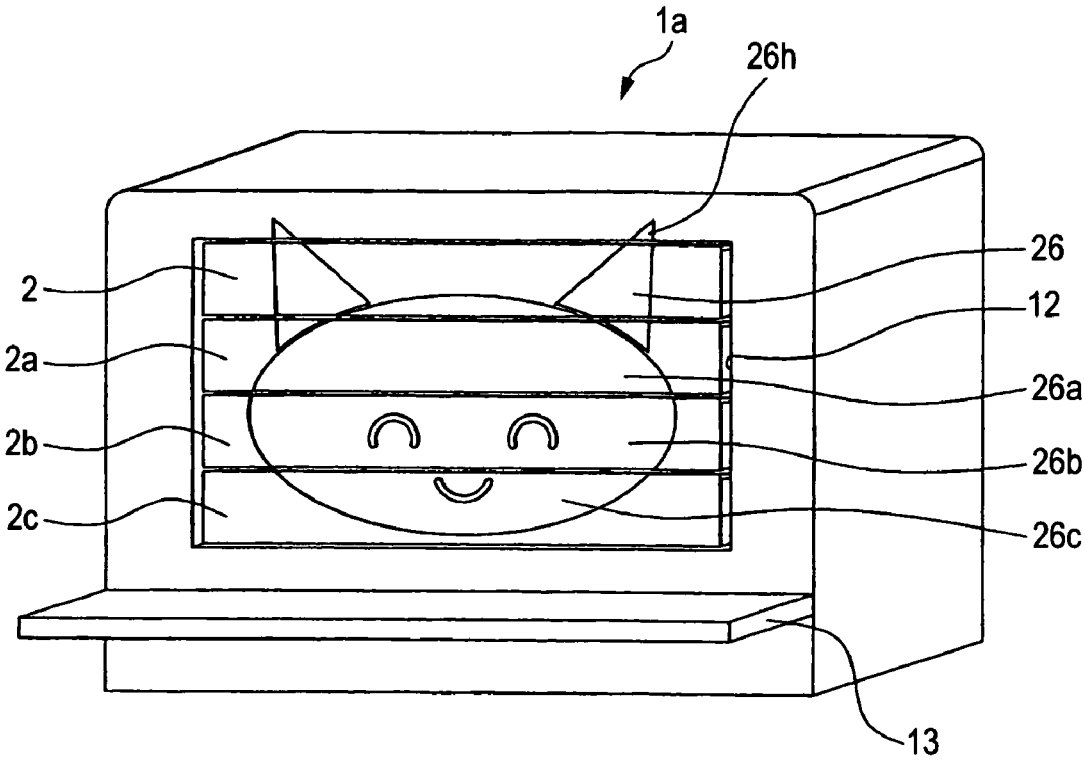
FIGS. 7A and 7B are views showing other picture splits provided in front surfaces of replaceable units.
Figure 7B:
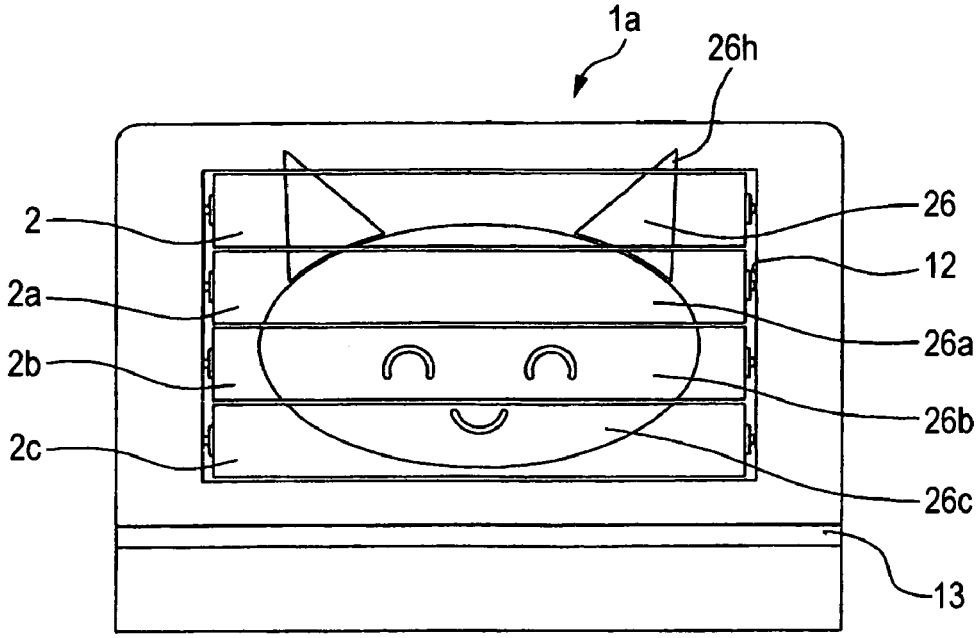

Next, another measure taken on the replaceable unit to prohibit incorrect attachment of replaceable units into an image forming apparatus will be described with reference to FIGS. 5A, 5B, 6A, 6B, 7A and 7B. FIGS. 5A and 5B are views showing picture splits provided in front surfaces of replaceable units. Each of FIGS. 6A and 6B is a view showing a state where the picture splits cannot form a finished picture. FIGS. 7A and 7B are views showing other picture splits provided in front surfaces of replaceable units.

FIG. 5A is a perspective view showing a state in which four replaceable units 2, 2*a*, 2*b* and 2*c* have been inserted into the storage portion 12 of the image forming apparatus 1 in accordance with a proper insertion direction and proper insertion positions. FIG. 5B is a front view showing the state depicted in FIG. 5A.

As shown in FIG. 5B, an upper end portion of a picture split 25 provided in the replaceable unit 2 matches with a lower end portion of a picture split (a second picture split) 25*h* provided in the front surface 11 of the image forming apparatus 1. A lower end portion of the picture split 25 provided in the replaceable unit 2 matches with an upper end portion of a picture split 25*a* provided in the replaceable unit 2*a*. Similarly, the picture split 25*a* provided in the replaceable unit 2*a* matches with a picture split 25*b* provided in the replaceable unit 2*b*. The picture split 25*b* provided in the replaceable unit 2*b* matches with a picture split 25*c* provided in the replaceable unit 2*c*. A lower end portion of the picture split 25*c* provided in the replaceable unit 2*c* matches with an upper end portion of a picture split (a second picture split) 25*d* provided in the front surface 11 of the image forming apparatus 1.

In this manner, the four replaceable units 2, 2*a*, 2*b* and 2*c* can be inserted in the insertion positions in the proper insertion direction when a finished picture is formed from the picture splits even if the four replaceable units 2, 2*a*, 2*b* and 2*c* are equal in size and shape.

Each of FIGS. 6A and 6B shows a state where a finished picture is not formed from the picture splits.

FIG. 6A shows the case where the replaceable unit 2*a* turned upside down is inserted into the storage portion of the image forming apparatus 1 by mistake. In this case, the upper end portion of the picture split in the replaceable unit 2*a* does not match with the lower end portion of the picture split 25 in the replaceable unit 2, and the lower end portion of the picture split in the replaceable unit 2*a* does not match the upper end portion of the picture split 25*b* in the replaceable unit 2*b*.

Accordingly, the user can recognize easily the incorrect attachment of the replaceable unit 2*a* because a finished picture is not formed from the picture splits.

FIG. 6B shows the case where the replaceable units 2 and 2*c* confused with each other are inserted into the storage portion. In this case, the upper end portion of the picture split 25*c* in the replaceable unit 2*c* does not match with the lower end portion of the picture split 25*h* provided in the front surface 11 of the image forming apparatus 1, and the lower end portion of the picture split 25*c* in the replaceable unit 2*c* does not match with the upper end portion of the picture split 25*a* in the replaceable unit 2*a*. In addition, the upper end portion of the picture split 25 in the replaceable unit 2 does not match with the lower end portion of the picture split 25*b* in the replaceable unit 2*b*, and the lower end portion of the picture split 25 in the replaceable unit 2 does not match with the upper end portion of the picture split 25*d* provided in the front surface 11 of the image forming apparatus 1. Accordingly, the user can recognize easily the incorrect attachment of the replaceable units 2 and 2*c* because a finished picture is not formed from the picture splits.

FIGS. 7A and 7B show other picture splits provided in front surfaces of replaceable units.

FIG. 7A is a perspective view showing a state in which four replaceable units 2, 2*a*, 2*b* and 2*c* are inserted into a storage portion 12 of an image forming apparatus 1*a* in accordance with a proper insertion direction and proper insertion positions. FIG. 7B is a front view showing the state depicted in FIG. 7A.

As shown in FIG. 7B, an upper end portion of a picture split 26 provided in the replaceable unit 2 matches with a lower end portion of a picture split 26*h* provided in the front surface 11, of the image forming apparatus 1*a*. A lower end portion of the picture split 26 provided in the replaceable unit 2 matches with an upper end portion of a picture split 26*a* provided in the replaceable unit 2*a*. Similarly, the picture split 26*a* provided in the replaceable unit 2*a* matches with a picture split 26*b* provided in the replaceable unit 2*b*. The picture split 26*b* provided in the replaceable unit 2*b* matches with a picture split 26*c* provided in the replaceable unit 2*c*.

In this manner, the four replaceable units 2, 2*a*, 2*b* and 2*c* can be inserted in the proper insertion positions in the proper insertion direction when a finished picture is formed from the picture splits even if the four replaceable units 2, 2*a*, 2*b* and 2*c* are equal in size and shape.

Figure 8:
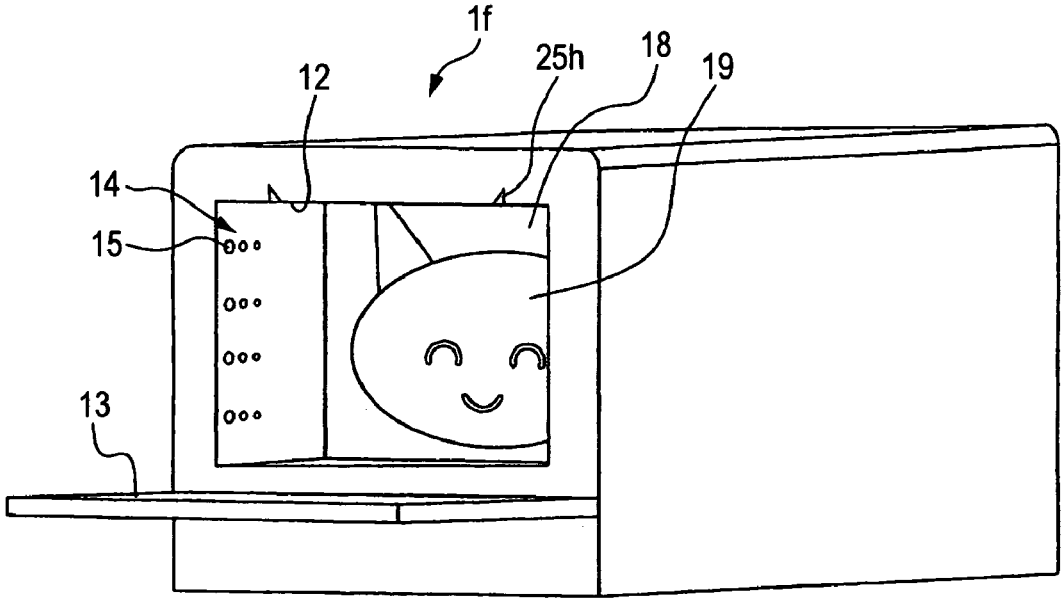
FIG. 8 is a view showing an example in which an original picture which has not been split into picture splits yet is drawn on the image forming apparatus side in advance.

Moreover, an original picture which has not been split into picture splits yet may be drawn on a rear end surface of the storage portion 12 of the image forming apparatus 1*a* in advance. In this case, the user can form a finished picture from the picture splits more easily. FIG. 8 shows the case where an original picture which has not been split into picture splits yet is drawn on the image forming apparatus side in advance.

An original picture 19 of picture splits 26, 26*a*, 26*b* and 26*c* is drawn on a rear end surface 18 of the storage portion 12 of the image forming apparatus if shown in FIG. 8. The user can insert the four replaceable units 2, 2*a*, 2*b* and 2*c* in the proper insertion positions easily because the insertion of the replaceable units 2, 2*a*, 2*b* and 2*c* is completed when the replaceable units 2, 2*a*, 2*b* and 2*c* are inserted while the original picture 19 is viewed so that a finished picture is formed from the picture splits.

Incidentally, the finished picture formed from the picture splits is not limited to a pictorial design and may be a character design, a logotype design, a symbol design, a mark design or the like. In addition, when each of the picture splits is provided as a picture split having a concave and convex face in the front surface of the replaceable unit, the user can form a finished picture from the picture splits by using both visual sense and tactile sense.

Alternatively, each picture split having such a concave and convex face may be replaced by a picture split provided as a sticker so that the picture split provided as a sticker can be placed on the front surface of a corresponding replaceable unit. In this case, it is unnecessary to produce a mold for the picture split having a concave and convex face, and it is therefore possible to reduce the cost for production of the replaceable unit.

Figure 9:
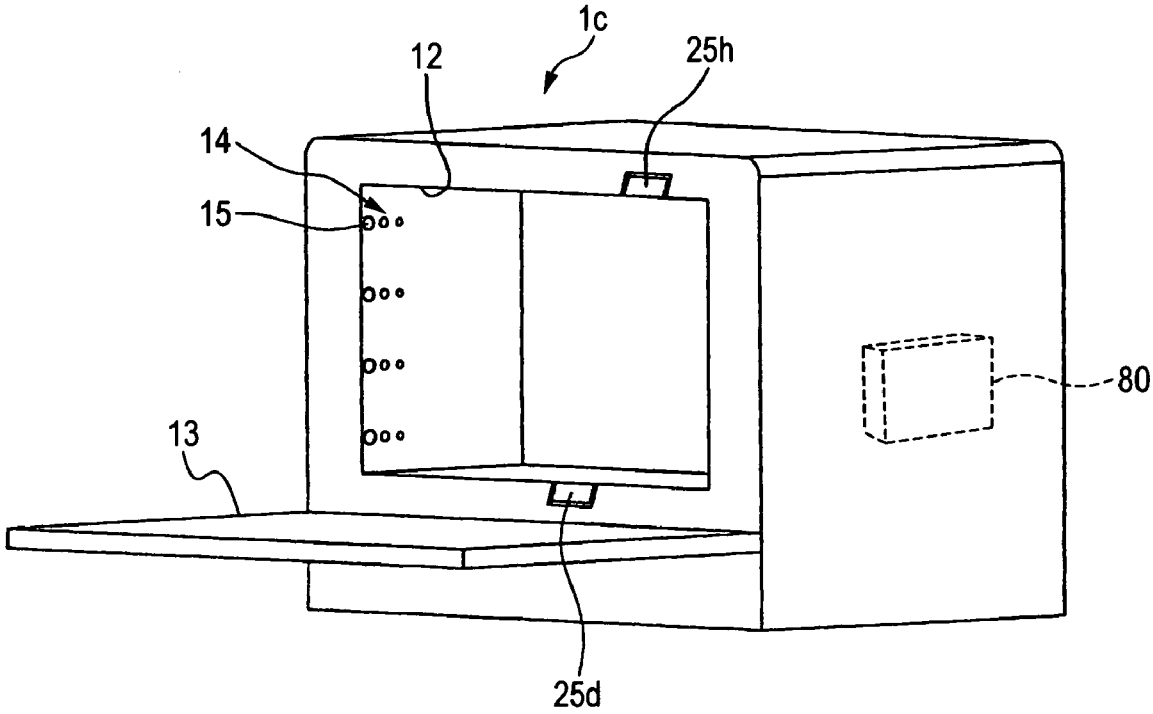
FIG. 9 is a view showing light emitting portions provided in a storage portion of an image forming apparatus.

Referring to FIG. 9, description will be made below on an image forming apparatus which includes a storage portion for storing replaceable units, and light emitting portions provided in a wall surface of the storage portion for indicating the positions where the replaceable units are stored, as the case where a measure to prohibit the incorrect attachment of the replaceable units is taken on the image forming apparatus side on which the replaceable units are attached into the storage portion.

FIG. 9 is a view showing the light emitting portions provided in the storage portion of the image forming apparatus. The light emitting portions 14 are provided in the storage portion 12 of the image forming apparatus 1*c*. The light emitting portions 14 have arrays of point light sources 15 respectively. The arrays of point light sources 15 are arranged along the direction of storage of the replaceable units 2, 2*a*, 2*b* and 2*c*. The user can recognize the direction of storage of the replaceable units 2, 2*a*, 2*b* and 2*c* visually from the arrays of point light sources 15. In the case of the image forming apparatus 1*c*, the inside of the storage portion can be illuminated without any shadow being generated in the inside of the storage portion because four light emitting portions 14 and three point light sources per light emitting portion 14 are provided in the storage portion 12. Each point light source 15 is made of an LED. Accordingly, the illuminance of light emitted from the LEDs permits the user to visually recognize the direction of storage of the replaceable units 2, 2*a*, 2*b* and 2*c* easily and permits the storage portion 12 of the image forming apparatus 1*c* to be illuminated sufficiently brightly.

In addition, the image forming apparatus 1*c* is provided with a first control unit 80 for sequentially turning on the arrays of point light sources 15 from the front side to the rear side with respect to the direction of storage of the replaceable units 2, 2*a*, 2*b* and 2*c*. When the user opens a door 13 with which the storage portion 12 is covered, an open-close sensor not shown informs the first control unit 80 of the opening of the door 13. As a result, the arrays of point light sources 15 are turned on and blinked on and off successively with respect to the direction of insertion of the replaceable units 2, 2*a*, 2*b* and 2*c*. Accordingly, the user can recognize the positions of insertion of the replaceable units 2, 2*a*, 2*b* and 2*c* and the direction of insertion of the replaceable units 2, 2*a*, 2*b* and 2*c*.

Although FIG. 9 shows the case where the light emitting portions 14 are provided only on the left side of the storage portion 12 of the image forming apparatus 1*c* with respect to the direction of storage of the replaceable units 2, 2*a*, 2*b* and 2*c*, the invention may be applied to the case where the light emitting portions 14 are provided in at least one of the left and right sides of the storage portion 12 or to the case where the light emitting portions 14 are provided in both left and right sides of the storage portion 12.

Figure 10:
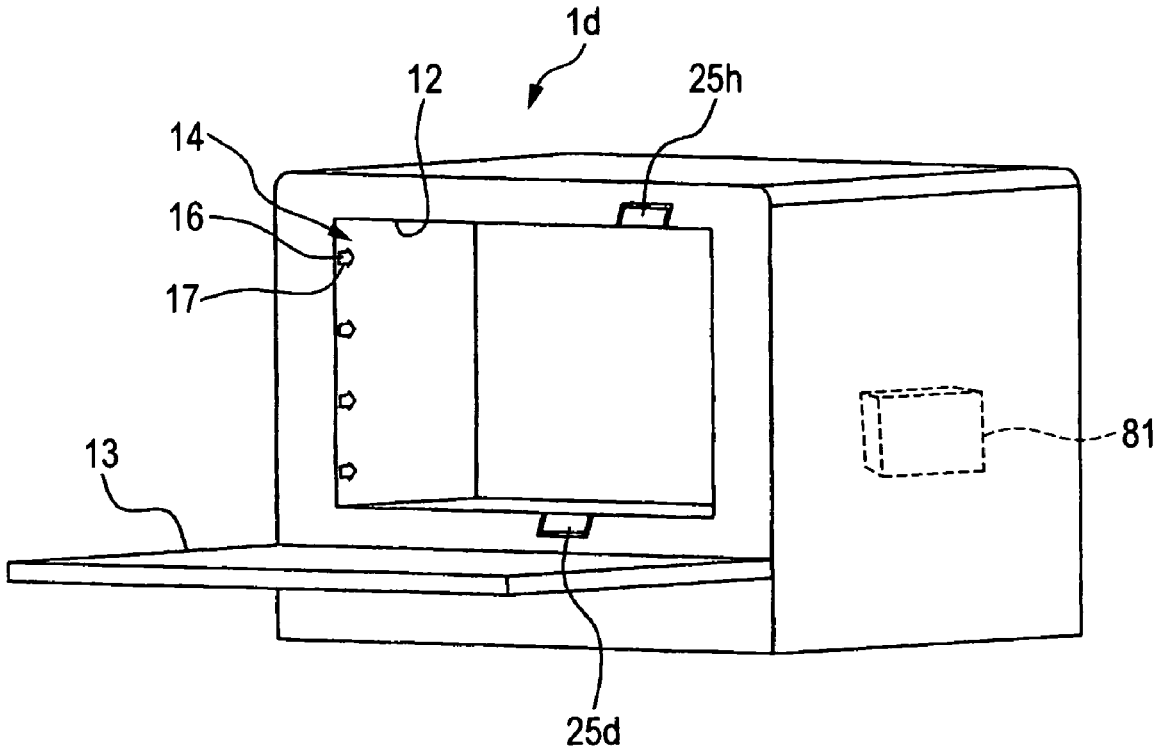
FIG. 10 is a view showing light emitting portions provided in a storage portion of an image forming apparatus.

FIG. 10 shows another example of the light emitting portions 14 provided in the storage portion 12 of an image forming apparatus 1*d*. Each light emitting portion 14 has a light transmissive member 16, and an illumination member 17.

The light transmissive member 16 is provided in a wall surface of the storage portion 12 and shaped like an arrow indicating the position and direction of storage of a corresponding replaceable unit 2, 2*a*, 2*b* or 2*c*. The illumination portion 17 illuminates the light transmissive member 16 from the back. The image forming apparatus 1*d* is provided with a second control unit 81 for blinking on and off the illumination member 17 when a door 13 with which the storage portion 12 is covered is opened. When the user opens the door 13 with which the storage portion 12 is covered, an open-close sensor not shown informs the second control unit 81 of the opening of the door 13. As a result, the second control unit 81 blinks on and off the illumination members 17. Accordingly, the user can recognize the positions and direction of insertion of the replaceable units 2, 2*a*, 2*b* and 2*c*.

Although FIG. 10 shows the case where the light emitting portions 14 are provided only on the left side of the storage portion 12 of the image forming apparatus 1*d* with respect to the direction of storage of the replaceable units 2, 2*a*, 2*b* and 2*c*, the invention may be applied to the case where the light emitting portions 14 are provided in at least one of the left and right sides of the storage portion 12 or to the case where the light emitting portions 14 are provided on both left and right sides of the storage portion 12.

Although the embodiment has been described with the case where process cartridges are used as the replaceable units, the present invention can be also applied to the case where replaceable parts of a copying machine such as toner cartridges, drum cartridges, glass run-covers of a scanner, and scorotrons, besides the process cartridges, are used as the replaceable units.

As described above with reference to the embodiment, according to the embodiment, color contrast can be formed between the first cover member and the second cover member because the first cover member and the second cover member are different in color from each other. The color contrast improves visual recognition of the shape indicating the direction of attachment/detachment of the replaceable unit into/from the image forming apparatus. In addition, the labor for producing and pasting a label can be saved because the label is dispensed with. Thus, there never occurs such a problem that the direction of insertion of the replaceable unit cannot be found out when the label is peeled or damaged.

According to the embodiment, the protrusions of the second cover member are fitted into the through holes of the first cover member so that the first cover member and the second cover member can be locked to each other. As a result, the protrusions can serve also as members for connecting the first and second cover members to each other.

When the thickness of each of the protrusions of the second cover member and the thickness of a portion of each of the through holes of the first cover member are changed, unevenness is generated between the portion of the second cover member for filling the through hole and the first cover member. As a result, a user can recognize the direction of insertion of the replaceable unit by tactile sense through touching the unevenness with fingers or the like. Accordingly, the user can recognize the direction of insertion of the replaceable unit into the image forming apparatus by both visual sense and tactile sense.

According to the embodiment, the protrusions engage with front end portions of the through holes when the second cover member is inserted into the first cover member. Accordingly, the second cover member inserted into the first cover member is prevented from unintentional detachment from the first cover member.

According to the embodiment, the protrusions are locked in the through holes to prevent the replaceable unit from dropping out from the image forming apparatus. Accordingly, the replaceable unit is prevented from dropping out from the image forming apparatus because the second cover member inserted into the first cover member is never disconnected from the first cover member when the replaceable unit is detached from the image forming apparatus.

According to the embodiment, the image forming apparatus includes a storage portion for storing replaceable units; and a mechanism for storing the replaceable units in the image forming apparatus when the replaceable units are inserted from the storage portion toward the front end portions of the replaceable units.

According to this configuration, the user can store and lock the replaceable units into the image forming apparatus by inserting the replaceable units in a direction of from the storage portion toward the front end portion.

According to the embodiment, the user need not confirm the attachment of the replaceable units because the user cannot recognize the through holes visually in the condition that the replaceable units are stored in the storage portion. Accordingly, the user's labor for such an operation can be saved.

According to the embodiment, the picture splits provided on both a replaceable unit side and an image forming apparatus side separately are formed in portions of the replaceable units which can be visually recognized by a user of the replaceable units in the condition that the replaceable units are stored in the image forming apparatus.

According to this configuration, the user can insert the replaceable units in proper insertion places by storing the replaceable units in the image forming apparatus and completing a finished picture from the picture splits.

According to the embodiment, a finished picture is not formed from the picture splits when the replaceable units are intended to be stored in the image forming apparatus in a direction different from an original storage direction.

According to this configuration, the user can recognize the incorrect storage of the replaceable units in a direction different from the proper storage direction on the basis of the incompletion of the finished picture from the picture splits.

According to the embodiment, a finished picture is not formed from the picture splits when the replaceable units are intended to be stored in positions different from the original storage positions in the image forming apparatus.

According to this configuration, the user can recognize the incorrect storage of the replaceable units in positions different from the proper storage positions on the basis of the incompletion of the finished picture from the picture splits.

According to the embodiment, the user can complete the finished picture from the picture splits by tactile sense when the picture splits are provided as concave and convex portions formed in the replaceable units. Accordingly, the user can complete the finished picture from the picture splits by using both visual sense and tactile sense, so that it becomes easier to store the replaceable units in the proper storage direction and positions.

Moreover, it is unnecessary to produce a mold for applying the shape of concave and convex portions to the replaceable units when the picture splits are provided as stickers placed on the replaceable units. Accordingly, it is possible to reduce the cost for the production of the replaceable units.

According to the embodiment, the cover member is provided so that at least part of the picture splits are formed in a portion which can be visually recognized by a user of the replaceable units in the condition that the replaceable units are stored in the image forming apparatus.

According to this configuration, the user can recognize the direction of insertion of the replaceable units by completing the finished picture from the picture splits of the cover member.

According to the embodiment, the user can recognize the storage positions of the replaceable units by the light emitting portions.

According to the embodiment, the user can recognize the direction of the attachment of the replaceable units by the arrays of point light sources. In addition, the storage portion can be illuminated so that no shadow is generated in the inside of the image forming apparatus because of the arrays of point light sources.

According to the embodiment, the illuminance of light emitted from the LEDs permits the user to recognize the direction of the attachment of the replaceable units clearly and permits the storage portion of the image forming apparatus to be illuminated sufficiently brightly.

According to the embodiment, the user can recognize the direction of the attachment of the replaceable units because the point light sources are turned on sequentially toward the storage direction.

According to the embodiment, the user can recognize the position and direction of insertion of each replaceable unit because the first control unit 80 blinks on and off the point light sources when the door is opened.

According to the embodiment, the user can recognize the position and direction of insertion of each replaceable unit by the light transmissive members and the illumination members.

According to the embodiment, the second control unit 81 blinks on and off the illumination members when the door is opened. Accordingly, the light transmissive members blink on and off, so that the user can recognize the position and direction of insertion of each replaceable unit.

The foregoing description of the embodiment has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A replaceable unit that is detachably attached into a storage portion of a main body provided in an image forming apparatus, the replaceable unit comprising a first picture split provided on the replaceable unit that forms a finished picture with a second picture split provided on the main body of the image forming apparatus when the replaceable unit is attached into the storage portion wherein the picture split of the replaceable unit is provided at a portion that is visually recognizable in a condition that the replaceable unit is attached into the image forming apparatus.

2. The replaceable unit according to claim 1, wherein the picture split is provided so as not to form the finished picture when the replaceable unit is attached to the image forming apparatus in a direction different from an original attachment direction.

3. The replaceable unit according to claim 1, wherein the picture split is provided so as not to form the finished picture when the replaceable unit is attached to the image forming apparatus in a position different from a original attachment position.

4. The replaceable unit according to claim 1, wherein the picture split is provided as a sticker placed on the replaceable unit.

5. The replaceable unit according to claim 4 further comprising a cover member provided with at least part of the picture split on a portion that is visually recognizable when the replaceable unit is attached to the image forming apparatus.

6. A replaceable unit that is detachably attached into a storage portion of a main body provided in an image forming apparatus, the replaceable unit comprising a first picture split provided on the replaceable unit that forms a finished picture with a second picture split provided on the main body of the image forming apparatus when the replaceable unit is attached into the storage portion, wherein the picture split of the replaceable unit is provided at a portion that is visually recognizable in a condition that the replaceable unit is attached into the image forming apparatus and is provided as concave and convex portions formed on the replaceable unit.

7. An image forming apparatus comprising:

a main body that is provided with a storage portion; and a replaceable unit that is detachably attached to the storage portion and is provided with a first picture split, wherein the main body is further provided with a second picture split that forms a finished picture with the first picture split when the replaceable unit is attached to the storage portion, wherein the second picture split is provided at a portion that is visually recognizable when the replaceable unit is attached into the image forming apparatus.

* * * * *